US011365607B2

(12) United States Patent
Al-Driweesh

(10) Patent No.: US 11,365,607 B2
(45) Date of Patent: Jun. 21, 2022

(54) METHOD AND SYSTEM FOR REVIVING WELLS

(71) Applicant: SAUDI ARABIAN OIL COMPANY, Dhahran (SA)

(72) Inventor: Saad Al-Driweesh, Udhailiyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 74 days.

(21) Appl. No.: 16/834,929

(22) Filed: Mar. 30, 2020

(65) Prior Publication Data

US 2021/0301624 A1 Sep. 30, 2021

(51) Int. Cl.

| | |
|---|---|
| ***E21B 37/00*** | (2006.01) |
| ***E21B 33/12*** | (2006.01) |
| ***E21B 47/04*** | (2012.01) |
| ***E21B 47/09*** | (2012.01) |

(52) U.S. Cl.
CPC ..... *E21B 37/00* (2013.01); *E21B 33/12* (2013.01); *E21B 47/04* (2013.01); *E21B 47/09* (2013.01)

(58) Field of Classification Search
CPC ..... E21B 37/00; E21B 47/04; E21B 33/12; E21B 47/09
See application file for complete search history.

(56) References Cited

U.S. PATENT DOCUMENTS 2,822,048 A * 2/1958 Tausch ..... E21B 43/14 166/114
4,988,389 A * 1/1991 Adamache ..... E21B 36/04 166/105
5,004,007 A * 4/1991 Johnson ..... E21B 34/06 137/155
6,220,356 B1 4/2001 Spikes
2003/0069143 A1* 4/2003 Collins ..... C09K 8/54 507/200
2003/0198562 A1 10/2003 Blauch et al.
(Continued)

FOREIGN PATENT DOCUMENTS

CN 103527152 A 1/2014
CN 106869902 A 6/2017
(Continued)

OTHER PUBLICATIONS

International Search Report issued in corresponding International Application No. PCT/US2020/030594, dated Nov. 4, 2020 (4 pages).
(Continued)

*Primary Examiner* — Steven A MacDonald
(74) *Attorney, Agent, or Firm* — Osha Bergman Watanabe & Burton LLP

(57) ABSTRACT

A method for reviving a well may include deploying a tube between a casing and a wellbore tubular of the well. The tube may extend from a surface through a port at a wellhead of the well to a section of the well at a depth above a packer. The method may include pumping down, through the tube, non-corrosive material into the section of the well. The well may be blocked below the packer by well blockage. The method may include destroying the well blockage by dissolving the well blockage using the non-corrosive material. The method may include pumping up, through the wellhead, the well blockage dissolved in the non-corrosive material.

11 Claims, 6 Drawing Sheets

(56) References Cited

U.S. PATENT DOCUMENTS

| | | | | |
|---|---|---|---|---|
| 2004/0094296 | A1* | 5/2004 | Richards | E21B 49/087 166/250.08 |
| 2004/0168800 | A1 | 9/2004 | Sask | |
| 2009/0090503 | A1* | 4/2009 | Groves | E21B 43/003 166/249 |
| 2010/0186952 | A1 | 7/2010 | Heisel et al. | |
| 2014/0144615 | A1* | 5/2014 | Richards | E21B 29/04 166/66 |
| 2014/0332227 | A1* | 11/2014 | Randazzo | E21B 43/123 166/372 |
| 2015/0053415 | A1* | 2/2015 | Windegaard | E21B 43/123 166/373 |
| 2016/0010415 | A1* | 1/2016 | Myhre | E21B 29/04 166/290 |
| 2016/0053579 | A1* | 2/2016 | Salihbegovic | F16K 25/04 166/374 |
| 2016/0102531 | A1 | 4/2016 | Keinath et al. | |
| 2017/0226824 | A1* | 8/2017 | Darby | F04B 49/065 |
| 2018/0038186 | A1* | 2/2018 | Ross | E21B 17/042 |
| 2018/0149003 | A1 | 5/2018 | Xiao et al. | |
| 2019/0022560 | A1* | 1/2019 | De Sorbier | E21B 17/012 |

FOREIGN PATENT DOCUMENTS

| | | | |
|---|---|---|---|
| GB | 1448706 | A | 9/1976 |
| KR | 101551793 | B1 | 9/2015 |
| RU | 2422619 | C1 | 6/2011 |
| WO | 2013/051958 | A1 | 4/2013 |
| WO | 2015164841 | A1 | 10/2015 |
| WO | 2018/026370 | A1 | 2/2018 |

OTHER PUBLICATIONS

Written Opinion issued in corresponding International Application No. PCT/US2020/030594, dated Nov. 4, 2020 (6 pages).

* cited by examiner

METHOD AND SYSTEM FOR REVIVING WELLS

BACKGROUND

A "production well" refers to a type of well used to extract hydrocarbons from subsurface deposits. A "dead well" refers to a production well that is no longer used for production. As such, a dead well is a well which can be temporarily or permanently unproductive and is deemed unfit for future production. There can be various reasons due to which a production well is re-labeled as a dead well. One reason is simply that the well is not capable of producing hydrocarbons as hydrocarbons can no longer flow because of liquid loading. The well might no longer have any sources left in the reservoir or there might be well blockage preventing hydrocarbons from reaching the surface.

SUMMARY

In general, in one aspect, embodiments disclosed herein relate to a method for reviving a well. The method includes deploying a tube between a casing and a wellbore tubular of the well. The tube extends from a surface through a port at a wellhead of the well to a section of the well at a depth above a packer. The method includes pumping down, through the tube, non-corrosive material into the section of the well, the well being blocked below the packer by well blockage. The method includes destroying the well blockage by dissolving the well blockage using the non-corrosive material. The method includes pumping up, through the wellhead, the well blockage dissolved in the non-corrosive material.

In general, in one aspect, embodiments disclosed herein relate to a system for reviving a well. The system includes a casing that prevents a formation wall from caving into wellbore tubular. The system includes a tube deployed in an annulus located between the wellbore tubular and the casing of the well. The tube extends from a surface through a port at a wellhead of the well to a section of the well at a depth above a packer. The system includes a housing for storing an amount of non-corrosive material for pumping down, through the tube, into the section of the well. The non-corrosive material destroys well blockage blocking the well below the packer by dissolving the well blockage in the non-corrosive material.

In general, in one aspect, embodiments disclosed herein relate to an assembly for reviving a well. The assembly includes a wellhead including means for transporting production fluid outside of the well. The wellhead is disposed at an openhole of the well. The assembly includes a casing that prevents a formation wall from caving into wellbore tubular. The assembly includes an annulus located between the wellbore tubular and the casing. The assembly includes a packer that seals the well. The assembly includes a tube deployed in the annulus. The tube extends from a surface through a port at the wellhead of the well to a section of the well at a depth above the packer. The assembly includes a housing for storing an amount of non-corrosive material for pumping down, through the tube, into the section of the well. The non-corrosive material destroys well blockage blocking the well below the packer by dissolving the well blockage in the non-corrosive material.

The foregoing general description and the following detailed description are exemplary of the invention and are intended to provide an overview or framework for understanding the nature of the invention as it is claimed. The accompanying drawings are included to provide further understanding of the invention and are incorporated in and constitute a part of the specification. The drawings illustrate various embodiments of the invention and together with the description serve to explain the principles and operation of the invention.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
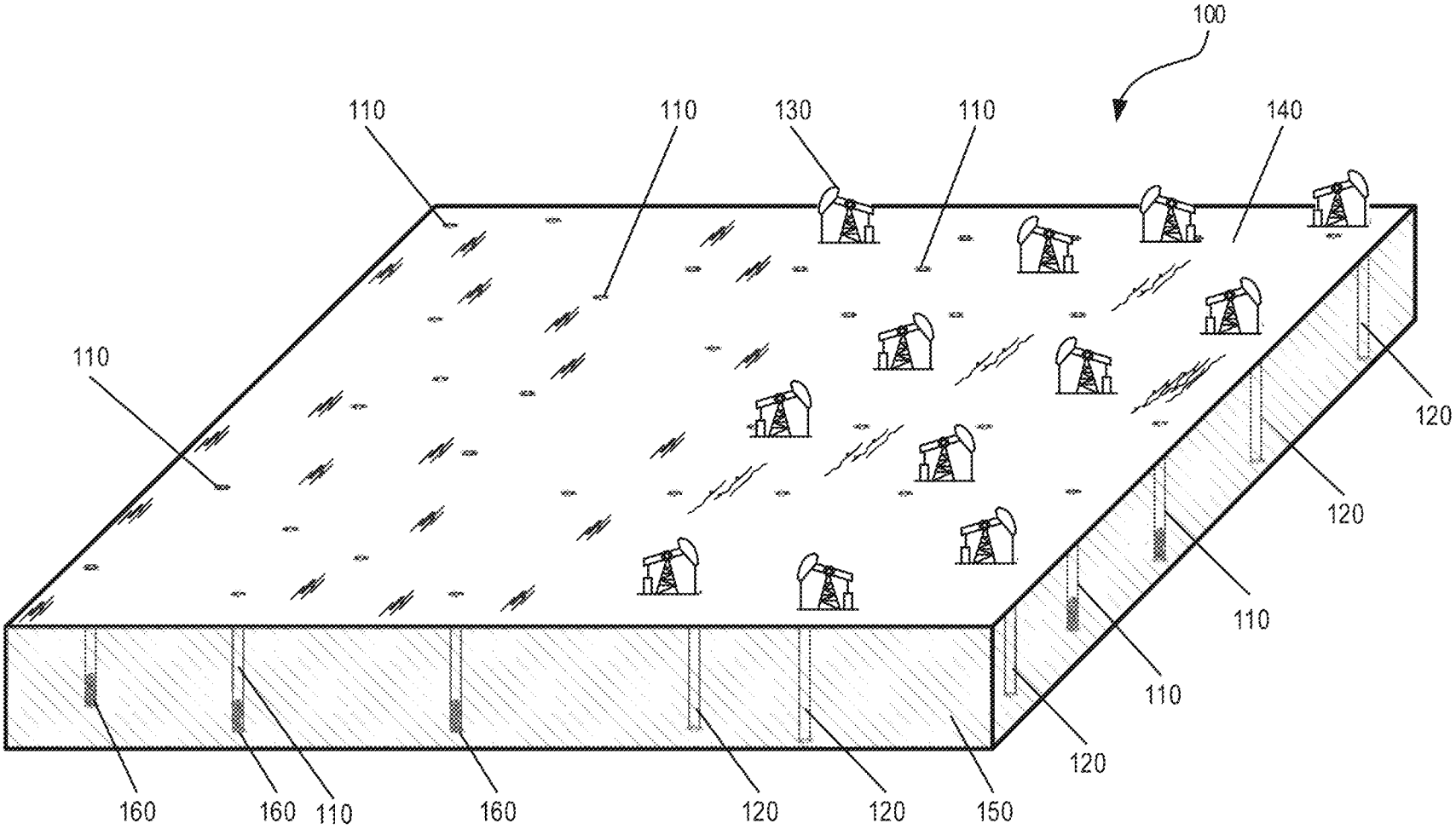
FIG. 1 shows a perspective view of an oilfield environment in accordance to one or more embodiments.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. In other instances, well known features or processes associated with the hydrocarbon production systems have not been shown or described in detail to avoid unnecessarily obscuring descriptions of the implementations and embodiments. For the sake of continuity, and in the interest of conciseness, same or similar reference characters may be used for same or similar objects in multiple figures.

In implementations described herein, a method and a system for reviving a dead well may remove well blockage accumulated below a packer in the dead well. The well blockage may be part of sediment accumulated during well production or during a process for making the well ready for production. In some embodiments, the dead well may be revived by using a tube to pump non-corrosive material (i.e., liven fluid or scale and/or corrosion inhibitors) into the wellbore, allowing for the non-corrosive material to dissolve well blockage, and extracting dissolved well blockage. Upon extracting the dissolved well blockage, the well may be put back into production through one or more stimulation processes if the well does not spring into production through the extraction of the dissolved well blockage.

The dead well may be disposed in an oilfield including a combination of production wells and dead wells. The production wells and the dead wells may be located adjacent to wells of a same type or to wells of a different type. The dead wells may be determined to be unfit for production due to an overabundance of well blockage (i.e., condensate and/or water) in the wells. Further, the dead wells may be wells in which stimulation processes have failed to restart production.

In one or more embodiments, the method and the system unload the dead well by extracting the dissolved well blockage. The method may include deploying a tube (i.e., a stainless steel tube or a velocity string) installed in an annulus of the well between a casing and production tubing (i.e., wellbore tubular) above a packer. Further, the method and the system may include pumps coupled to the tube for pumping non-corrosive material down through the tube into the production tubing to lift well blockage that is loading the production tubing. At least two check valves may be installed in the tube to allow the non-corrosive material to be pumped through the tube while ensuring that no production fluid flows up through the tube. The tube may be used to pump the corrosion material to a location close to perforations in the casing. The annulus may also be filled with an inhibitor fluid to prevent corrosion or scale. Once the well blockage is dissolved, the pumps may be used for extracting the dissolved well blockage and additional production fluid through the production tubing.

FIG. 1 illustrates an example of an oilfield environment 100 including various wells extending from a surface area 140 into a subterranean area 150. The wells may be dead wells 110 or production wells 120. Dead wells 110 may be wells decommissioned or deemed not fit for production due to irreparable accumulation of well blockage 160 in the wellbore. The well blockage 160 may be solidified rock or material that has clogged production lines in the wellbore to the point that fluid may not flow freely through the wellbore. Production wells 120 may be wells currently used for production or wells that are not inflicted by well blockage in the manner described with respect to the dead wells 110. Well blockage 160 may not be limited to dead wells 110 and production wells 120 may have a small amount of well blockage 160 that does not affect production.

The oilfield environment 100 may include various surface elements, such as various pumps 130 disposed atop each production well 120 in the surface area 140. The pumps 130 may be standalone pumps connected to fluid tanks or containers for storing materials (not shown), such as materials used in well production. Further, the oilfield environment 100 may include various surface elements, such as various wellheads (not shown) disposed atop each well in the surface area 140. In the case of the dead wells 110, the wellhead may be a sealing lid that locks access to the well.

In one or more embodiments, as described above, it may be advantageous to revive dead wells 110. That is, it may be advantageous to transition dead wells 110 into production wells 120 and to restart production. Because the well blockage 160 remains in all dead wells, it may be advantageous to implement a method and a system for reviving the dead well by removing the well blockage. These method and system will be described in more detail with respect to FIGS. 2-5.

Figure 2:
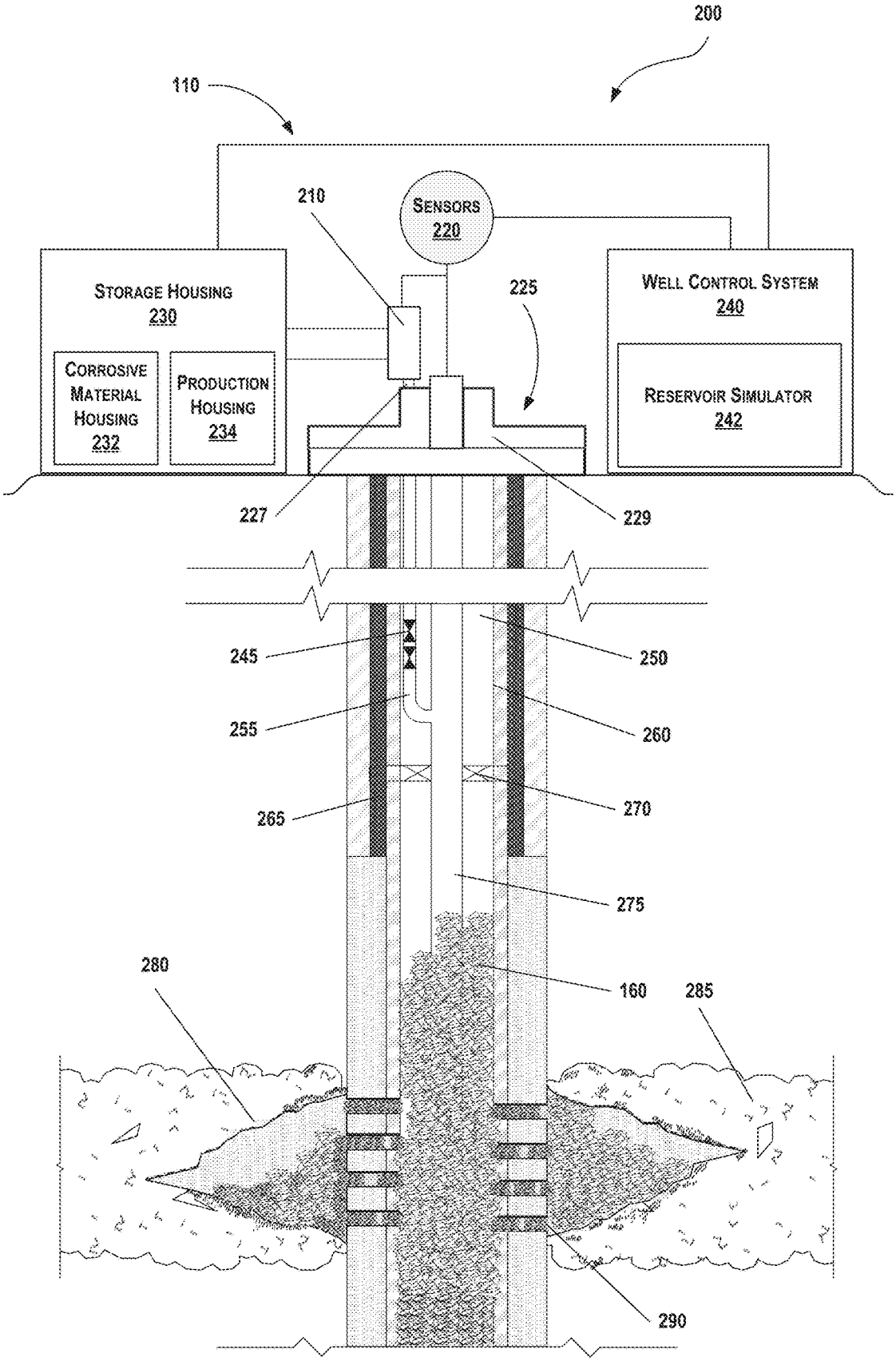
FIG. 2 shows a perspective view of a well environment including a reviving well system in accordance to one or more embodiments.

FIG. 2 shows a schematic diagram illustrating a well environment that includes a well 110 extending below a surface into a subsurface formation ("formation") 285. Formation 285 may include a porous or fractured rock that resides underground, beneath Earth's surface ("surface"). A subsurface pool of hydrocarbons, such as oil and gas, also known as a reservoir, may be located in formation 285. Well 110 includes a wellbore 260 that extends from a wellhead 225 at the surface to a target zone in formation 285—the target zone may be where the reservoir (not shown separately) is located. Well 110 may further include a casing 265 lining a portion of wellbore 260. In the illustrated example, casing 265 extends into the portion of wellbore 260 penetrating formation 285. One or more perforations 290 are formed in casing 265 to allow fluid communication between formation 285 and well 110. In other implementations, the portion of wellbore 260 penetrating formation 285 may be uncased or open, and fluid communication between formation 285 and well 110 may occur through the open wall section of well 110.

In one example, a tubing 275 may be disposed in well 110 to convey fluid into or away from well 110. Tubing 275 may extend from wellhead 225 and seals 229 into casing 265. An annulus 250 is formed between tubing 275 and casing 265. A packer 270 may be disposed in annulus 250, between casing 265 and tubing 275, to isolate the zone in which fluid is injected into or received from formation 285. If there is a clear path between formation 285 and the bottom opening of tubing 275, fluid may flow from formation 285 into tubing 275 for production or from tubing 275 into formation 285 for injection. However, in FIG. 2, well 110 is illustrated in a dead state, where well blockage 160 is in a position to prevent fluid communication between formation 285 and tubing 275. For illustrative purposes, well blockage 160 has filled the bottom of wellbore 260 up to the bottom of packer 270. Well blockage 160 may also partially fill tubing 275 from the bottom opening of tubing 275. In this position, fluid from formation 285 cannot flow into tubing 275, and fluid from tubing 275 cannot flow into formation 285.

FIG. 2 shows a schematic diagram illustrating a well system 200 that may be used to revive well 110 from the dead state. The well system 200 includes a tube 255 deployed into the annulus 250 from a position above packer 270. Tube 255 may be connected at one end to a port 227 at a surface of wellhead 225 and at another end to a section of tubing 275, thereby forming a flow path between port 227 and tubing 275. One or more valves 245 may be disposed in tube 255 to control flow of fluid through tube 255. In one example, a pair of one-way check valves (i.e., a double check valve) may be disposed in tube 255 to prevent fluid from tubing 275 from being pumped up, or from flowing up, tube 255 to port 227. At the same time, the check valves permit fluid to flow down tube 255 into tubing 275. The check valves are coupled one after another such that a first valve allows flow in one direction and prevent a flowback into the well. The second check valve is a backup valve incase the first check valve fails. In one or more embodiments, tube 255 may be a small diameter tube having a diameter that is smaller than a diameter of tubing 275. For example, a diameter range for the tube 255 may be from 0.5" to 2". In some cases, tube 255 may be velocity string, which is a type of small-diameter tubing string that is run inside a production tubing of a well for remedial treatment to resolve liquid-loading, except in this case tube 255 is run outside of tubing 275. Tube 255 may be made of a corrosion-resistant material, such as stainless steel.

The well system 200 may include a well control system ("control system") 240. The control system 240 may include flow regulating devices that are operable to control the flow of substances into and out of wellbore 260. For example, well control system 240 may include one or more production valves (not shown separately) that are operable to control the flow of production may control various operations of the well system 200, such as reviving well production operations and subsequent well completion operations, well maintenance operations, and reservoir monitoring, assessment and development operations.

The well system 200 may include various pumps 210 installed near the wellhead 225 for pumping material in and out of the well. The pumps 210 may include connections to the port 227 and the well control system 240. The storage housing 230 may be coupled to the pumps 210 for storing one or more types of materials used in reviving the dead well 110. The storage housing 230 may include storage tanks or containers with hydrocarbons extracted from the dead well 110 before it was determined to be out of production. The schematic diagram illustrates the well system 200 including connections from the wellhead to the pumps 210. The pumps 210 pumping down non-corrosive material from the storage housing 230 into the tube 255 and pumping up dissolved well blockage to the storage housing 230. The non-corrosive material may be stored in a non-corrosive material housing 232 and production fluid may be stored in a production housing 234. The non-corrosive material housing 232 and the production housing 234 may be located adjacent to one another or deployed at a distance from one another. Further, the storage housing 230 may be disposed near the well system 200 or at a distance from the well. As evidenced by the transition between FIG. 2, FIG. 3, and FIG. 4, the decrease in well blockage 160 is a direct result of increasing the non-corrosive material amount pumped into the dead well 110, the dead well 110 having an increasing ratio of dissolved well blockage.

The well control system 240 may be coupled to sensors 220 to sense characteristics of substances in storage housing 230, including production, passing through or otherwise located in the well system 200. The characteristics may include, for example, pressure, temperature, and flow rate of production flowing through the wellhead 225, or other conduits of the well control system 240, after exiting the wellbore 260.

The sensors 220 may include a surface pressure sensor operable to sense the pressure of production flowing to the well control system 240, after it exits the wellbore 260. The surface pressure sensor may sense the pressure of non-corrosive material flowing into the well control system 240 before it enters the wellbore 260. The sensors 220 may include a surface temperature sensor including, for example, a wellhead temperature sensor that senses a temperature of production flowing through or otherwise located in the wellhead, referred to as the "wellhead temperature" (Twh). In some embodiments, the sensors 220 include a flow rate sensor operable to sense the flow rate of production flowing through the well control system 240, after it exits the wellbore 260. The flow rate sensor may include hardware that senses the flow rate of production (Qwh) passing through the wellhead.

The well control system 240 includes a reservoir simulator 242. For example, the reservoir simulator 242 may include hardware and/or software with functionality for generating one or more reservoir models regarding the formation 285 and/or performing one or more reservoir simulations. For example, the reservoir simulator 242 may perform reviving analysis and estimation. Further, the reservoir simulator 242 may store well logs and data regarding core samples for performing simulations. While the reservoir simulator 242 is shown at a well site, embodiments are contemplated where reservoir simulators are located away from well sites. In some embodiments, the reservoir simulator 242 may include a computer system disposed to estimate a depth above the packer in which the tube 255 may be connected to the tubing 275. The computer system may also provide real time estimation, based on the feedback from the sensors 220, regarding an amount of non-corrosive material to pump down through the tube 255 in order to dissolve all the well blockage 160. Specifically, before deploying the tube, two one-way check valves may be installed inside the tube for preventing production fluid from being pumped up through the tube. The reservoir simulator 242 may include historical data about the well. The historical data may be information including a reservoir depth, a well production rate, a packer depth, a casing depth, and/or a well blockage depth. In this regard, an amount of the non-corrosive material may be determined for pumping down based on the depth estimated. The depth may be estimated based on at least one parameter associated to the non-corrosive material and the historical data of the well. In a process of identifying liquid loading and pumping non-corrosive material into a dead well, these parameters may include well pressure, tubing pressure increased to identify blockage, depth of blockage from a gradient calculation, an amount of non-corrosive material to be pumped, and/or a pump time duration.

In some embodiments, during operation of the well system 200, the control system 240 collects and records wellhead data for the well system 200. The wellhead data may include, for example, a record of measurements of wellhead pressure (Pwh) (e.g., including flowing wellhead pressure), wellhead temperature (Twh) (e.g., including flowing wellhead temperature), wellhead production rate (Qwh) over some or all of the life of the reviving well system 200, and water cut data. In some embodiments, the measurements are recorded in real-time, and are available for review or use within seconds, minutes or hours of the condition being sensed (e.g., the measurements are available within 1 hour of the condition being sensed). In such an embodiment, the wellhead data may be referred to as "real-time" wellhead data. Real-time wellhead data may enable an operator of the well system 200 to assess a relatively current state of the well system 200, and make real-time decisions regarding development of the well system 200 and the reservoir, such as on-demand adjustments in regulation of production flow from the well.

Figure 5:
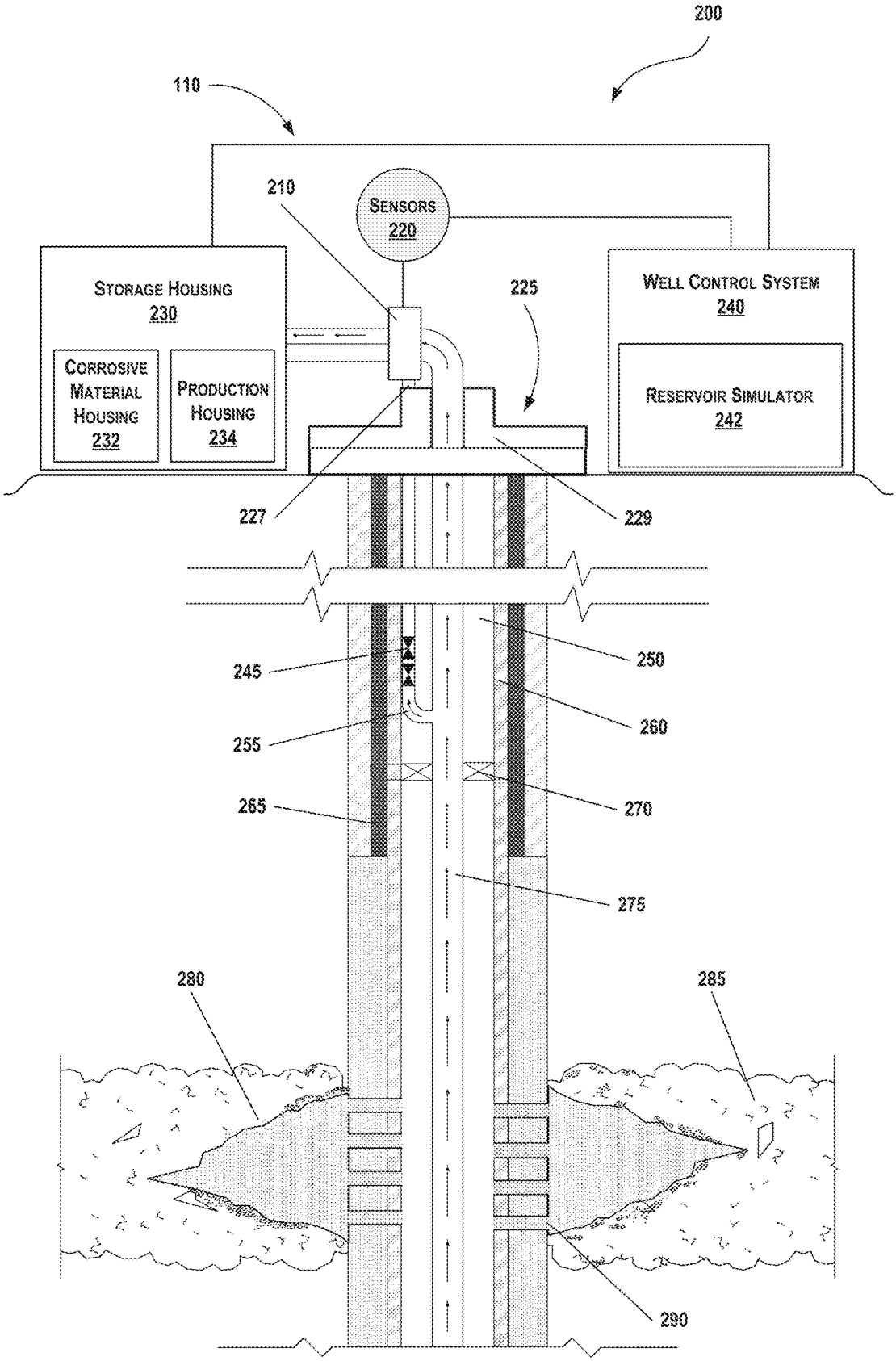
FIG. 5 shows a perspective view of a well environment including a production well in accordance to one or more embodiments.

FIG. 5 shows a schematic diagram illustrating a well environment that includes a reservoir located in a subsurface formation 285 and a production version of the well system 200 for a production well 120. The formation 285 may be freed all connections to the wellbore 260 and the one or more perforations 290. In the case of the well system 200 being a hydrocarbon well, the reservoir may include a portion of the formation 285 that includes a subsurface pool of hydrocarbons, such as oil and gas.

In some embodiments, the well system 200 includes the wellbore 260, and the well control system 240. The control system 240 may control various operations of the well system 200, such as well production operations, well completion operations, well maintenance operations, and reservoir monitoring, assessment and development operations.

The wellbore 260 may facilitate the circulation of drilling fluids during drilling operations, the flow of hydrocarbon production ("production") (e.g., oil and gas) from the reservoir to the surface during production operations, the injection of substances (e.g., water) into the formation 285 or the during injection operations, or the communication of monitoring devices (e.g., logging tools) into the formation 285 or the reservoir during monitoring operations (e.g., during in situ logging operations). In some embodiments, during operation of the well system 200, the control system 240 collects and records wellhead data for the well system 200. In some embodiments, the tube 255 disposed in the annulus 250 may inoperable until it is needed again In some embodiments, during operation of the well system 200, the control system 240 collects and records wellhead data for the well system 200. The wellhead data may include, for example, the record of measurements over some or all of the life of the well system 200, and water cut data. In such an embodiment, the wellhead data may be referred to as "real-time" wellhead data. Real-time wellhead data may enable an operator of the well system 200 to assess a relatively current state of the well system 200, and make real-time decisions regarding development of the well system 200 and the reservoir, such as on-demand adjustments in regulation of production flow from the well.

In some embodiments, the wellbore 260 may have a cased portion and an uncased (or "open-hole") portion. The cased portion may include a portion of the wellbore having casing (e.g., casing pipe and casing cement) disposed therein. The uncased portion may include a portion of the wellbore not having casing disposed therein. In some embodiments, the casing includes an annular casing 265 that lines the wall of the wellbore 260 to define an annulus 250 and the tubing 275 that provides a conduit for the transport of tools and substances through the wellbore 260 and upper and/or lower packers 270. For example, the central passage may provide a conduit for lowering logging tools into the wellbore 260, a conduit for the flow of production (e.g., oil and gas) from the reservoir to the surface, or a conduit for the flow of injection substances (e.g., water) from the surface into the formation 285. The wellbore 260 includes production tubing installed in the wellbore 260. The production tubing may provide a conduit for the transport of tools and substances through the wellbore 260. The production tubing may, for example, be disposed inside casing. In such an embodiment, the production tubing may provide a conduit for some or all of the production (e.g., oil and gas) passing through the wellbore 260 and the casing.

In some embodiments, the production well system 500 may include one or more production valves that are operable to control the flow of production. For example, a production valve may be fully opened to enable unrestricted flow of production from the wellbore 260.

Figure 3:
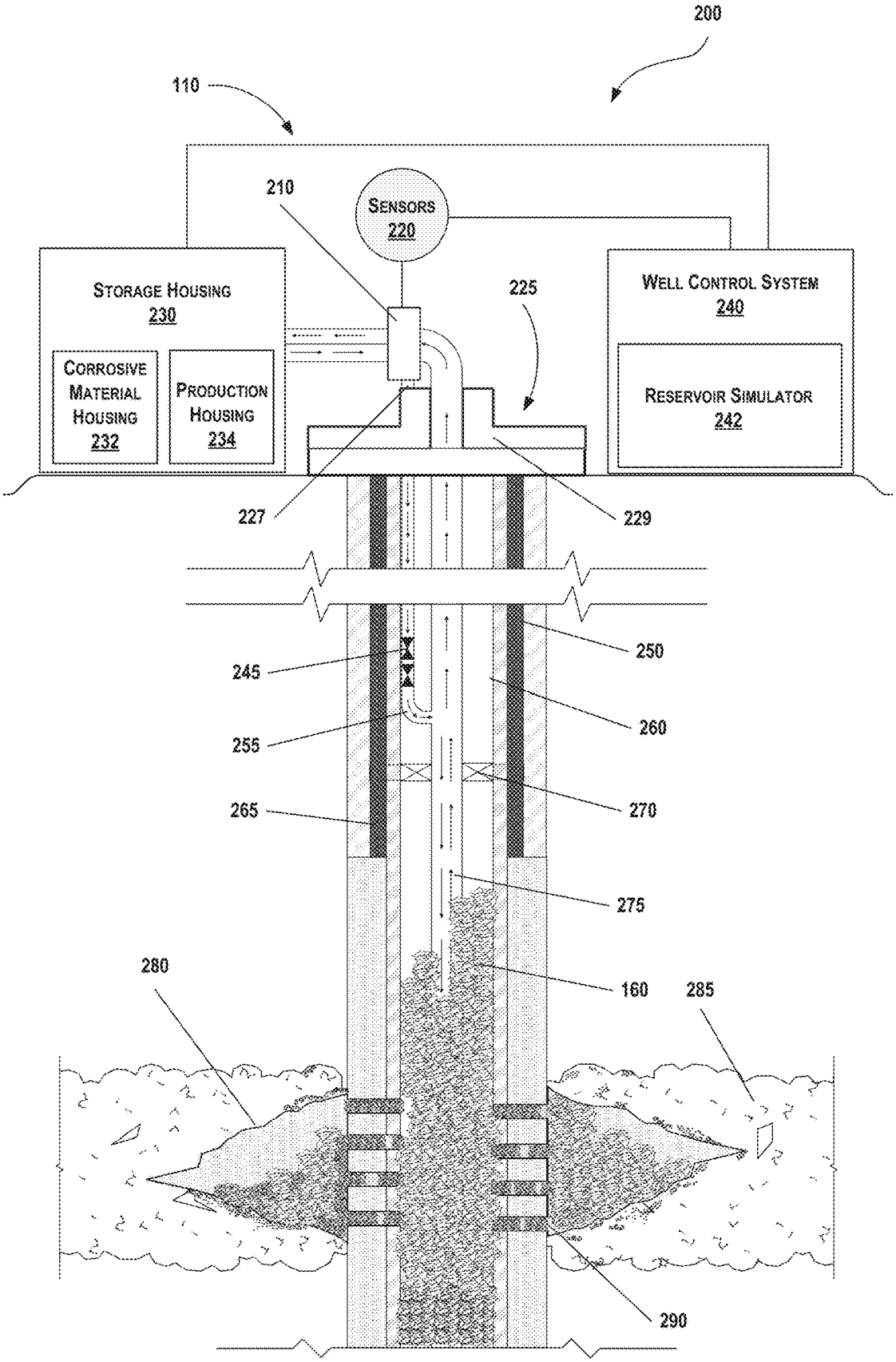
FIG. 3 shows a perspective view of a well environment including a reviving well system in accordance to one or more embodiments.
Figure 4:
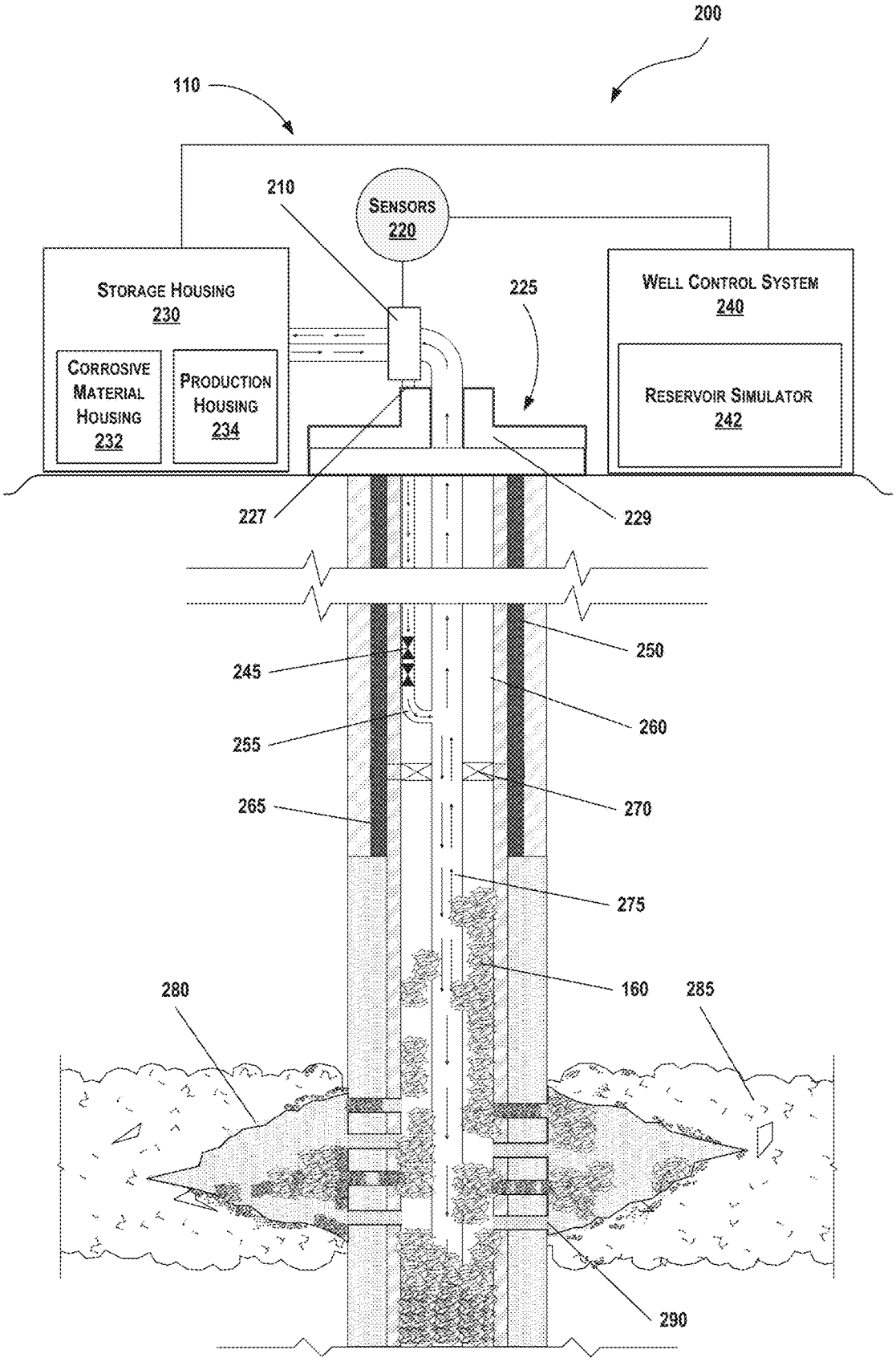
FIG. 4 shows a perspective view of a well environment including a dead well in accordance to one or more embodiments.

FIGS. 3 and 4 show schematic diagrams illustrating a well environment that includes a reservoir located in a subsurface formation 285 and a reviving version of the well system 200. Further, FIG. 5 shows a schematic diagram illustrating a fully revived well system without any blockage 160 left. In these cases, as evidenced by the transition between FIGS. 3-5, the decrease in well blockage 160 is a result of increasing the non-corrosive material amount pumped into the dead well 110, the dead well 110 having an increasing ratio of dissolved well blockage up to a point in which a reviving stage is reached. The reviving well 110 being a well that has started allowing hydrocarbons to reach the surface through clearing of previously blocked portions of the well.

Figure 6:
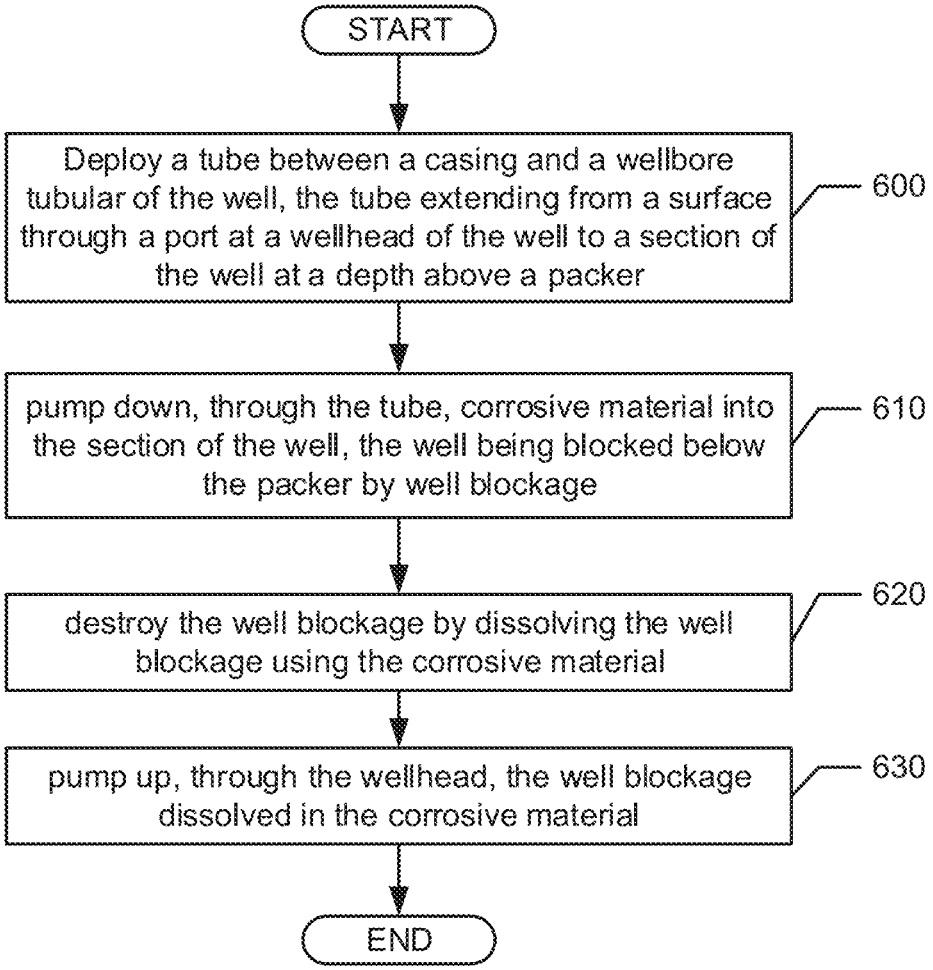
FIG. 6 shows a flowchart in accordance with one or more embodiments.

FIG. 6 shows a flowchart describing a method for reviving a well. One or more blocks in FIG. 6 may be performed by one or more components as described above in FIGS. 2-5 (for example, the various alerting means). While the various blocks in FIG. 6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

At 600, a tube is deployed in an annulus of a well between a casing and a wellbore tubular of the well. The tube may extend from a surface through a port at a wellhead of the well to a section of the well at a depth above a packer. The tube may be deployed during completion of the well, during production of the well, or upon determining whether the well is a dead well. Before deploying the tube, two one-way check valves may be installed inside the tube, the two one-way check valves may prevent production fluid from being pumped up through the tube. To this point, historical data may be obtained about the well. The historical data may be information including a reservoir depth, a well production rate, a packer depth, a casing depth, and/or a well blockage depth. An amount of the non-corrosive material may be determined for pumping down based on the depth estimated. The depth may be estimated based on at least one parameter associated to the non-corrosive material and the historical data of the well. The tube may be a stainless steel pipe or a velocity string made from high strength corrosion resistant alloys.

At 610, non-corrosive material may be pumped down through the tube and into the section of the well as long as the well being blocked below the packer by well blockage.

At 620, the well blockage may be destroyed by dissolving the well blockage using the non-corrosive material as described in reference to FIGS. 2 and 3.

At 630, the well blockage dissolved may be pumped up through the wellhead in the non-corrosive material until all non-corrosive material is taken out from the well and the dead well is turned into a production well. As such, the well may transition following the descriptions related to FIGS. 2-5.

While the invention has been described with respect to a limited number of embodiments, those skilled in the art, having the benefit of this disclosure, will appreciate that other embodiments can be devised that do not depart from the scope of the invention as described herein. Accordingly, the scope of the invention should be limited only by the accompanying claims.

What is claimed is:

1. A method for reviving a well, the method comprising:

deploying a tube between a casing and a wellbore tubular of the well, the tube extending from a surface through a port at a wellhead of the well to a section of the well at a depth above a packer;

pumping down, through the tube, non-corrosive material into the section of the well, the well being blocked below the packer by a well blockage;

destroying the well blockage by dissolving the well blockage using the non-corrosive material; and pumping up, through the wellhead, the well blockage dissolved in the non-corrosive material.

2. The method of claim 1, further comprising:

installing two one-way check valves inside the tube before deploying the tube, the two one-way check valves preventing production fluid from being pumped up through the tube.

3. The method of claim 1, further comprising:

obtaining historical data of the well, the historical data comprising a reservoir depth, a well production rate, a packer depth, a casing depth, or a well blockage depth.

4. The method of claim 3, further comprising:

estimating the depth based on at least one parameter associated to the non-corrosive material and the historical data of the well.

5. The method of claim 4, further comprising:

determining the section of the well based on the depth estimated; and determining an amount of the non-corrosive material for pumping down based on the depth estimated.

6. The method of claim 1, further comprising:

estimating the depth based on at least one parameter associated to the non-corrosive material; and determining the section of the well based on the depth estimated.

7. The method of claim 6, further comprising:

determining an amount of the non-corrosive material for pumping down based on the depth estimated.

8. The method of claim 1, wherein the non-corrosive material is a fluid comprising nitrogen.

9. The method of claim 1, wherein the tube is a stainless steel pipe or a velocity string made from high strength corrosion resistant alloys.

10. The method of claim 1, further comprising:

deploying the tube between the casing and the wellbore tubular of the well as part of a process for making the well ready for production.

11. The method of claim 1, wherein the deploying comprises connecting the tube to a section of the wellbore tubular above the packer, thereby forming a flow path between the port and the wellbore tubular.

* * * * *